US006283875B1

(12) United States Patent
Jones

(10) Patent No.: US 6,283,875 B1
(45) Date of Patent: Sep. 4, 2001

(54) METHOD OF GOLF CLUB SUPPORT AND ALIGNMENT

(76) Inventor: David W. Jones, P.O. Box 572, McCormick, SC (US) 29835

( * ) Notice: Subject to any disclaimer, the term of this patent is extended or adjusted under 35 U.S.C. 154(b) by 0 days.

(21) Appl. No.: 09/418,428

(22) Filed: Oct. 15, 1999

Related U.S. Application Data

(63) Continuation-in-part of application No. 09/078,607, filed on May 14, 1998, now abandoned.
(60) Provisional application No. 60/046,925, filed on May 16, 1997.

(51) Int. Cl.[7] ..... A63B 53/00
(52) U.S. Cl. ..... 473/282; 473/409; 211/70.2; 248/163.1; 248/688; 248/689
(58) Field of Search ..... 473/282–286; 211/70.2, 70.8; 248/83, 163.1, 688, 689, 176.1, 316.5, 96, 520; 206/315.2; 42/94; 269/254 R, 254 CS

(56) References Cited

U.S. PATENT DOCUMENTS 3,235,997 * 2/1966 Stoner .
3,235,998 * 2/1966 Hadley .
4,017,997 * 4/1977 Peterson .
4,397,112 * 8/1983 York .
5,230,507 * 7/1993 White .
5,413,329 * 5/1995 Hirsch .
5,482,247 * 1/1996 Smith .
5,492,230 * 2/1996 Horton .
5,765,820 * 6/1998 Marusiak .
5,782,704 * 7/1998 Tetler .
5,853,336 * 12/1998 Hufgard .

* cited by examiner

*Primary Examiner*—Jeanette Chapman
*Assistant Examiner*—Stephen L. Blau
(74) *Attorney, Agent, or Firm*—Peter A. Borsari

(57) ABSTRACT

A support and alignment implement for supporting an article such as a golf club in an upright or elevated position comprises a pair of leg members, each leg member having a stretched "C" shaped proximal end and a ground engaging distal end, a spring element disposed between the proximal ends and means for joining the proximal ends such that the spring element is retained therein and maintains the proximal ends of the leg members in contact with one another in a closed position. In operation, the user extends the proximal ends of the leg members away from one another to an open position, such as by bringing. together the distal ends of the leg members, inserts the shaft of the golf club between the stretched "C" shaped proximal ends, and returns the proximal ends to the closed position, thereby securing the shaft between the proximal ends. The ground-engaging distal ends and are placed on the ground and with the golf club head form a tripod-like configuration, thereby maintaining the golf club in an upright position. Once in this upright position, the golf club can be arranged to correspond with a player's stance, thereby enabling a player to visually observe the selected alignment and angle of the face of the golf club head with the intended line of play and the intended target.

12 Claims, 5 Drawing Sheets

METHOD OF GOLF CLUB SUPPORT AND ALIGNMENT

RELATED APPLICATIONS

This application is a continuation-in-part of U.S. patent application Ser. No. 09/078,607, filed May 14, 1998, now abandoned, which claims priority from U.S. Provisional Patent Application 60/046,925, filed May 16, 1997.

FIELD OF INVENTION

The present invention generally relates to field of support and alignment implements and particularly relates to a device for supporting an article having an elongated shaft, such as a golf club or similar article. More specifically, in a preferred embodiment, the device of the present invention relates to a golfing accessory for supporting a golf club in a upright position and for providing a visual alignment of the golf club relative to the intended line of play.

BACKGROUND OF THE INVENTION

The game of golf is an increasingly popular sport not only in the United States but throughout the world. As the sport has grown in popularity, the number of golfing accessory items introduced on the market has multiplied in kind. Among the many types of devices developed to enhance the playing of golf are devices which support a golf club in an upright position, rather than laying the club on the fairways and putting greens, such that the handle of the golf club does not contact the ground. These support devices not only prevent the golf handle from getting wet or muddy as the result of morning due or earlier rains, but also allow golfer to grab his club without having to bend. In addition, the use of such support devices prevent contamination of the golf club grips from chemicals, pesticides and fertilizers which commonly are used in the maintenance of golf courses, thereby preventing such chemicals from being transferred to the hands and body of the golfer.

The prior art is replete with numerous devices designed to support a golf club in an upright position. For example, U.S. Pat. No. 5,230,507 to White et al. provides a portable golf club supporting aid having a notched opening for receiving a shaft of a club. In operation, the golfer inserts the club shaft within the notched opening and must slide the device off of the supporting aid when he wishes to use the club. A more complicated device is shown in U.S. Pat. No. 5,492,230 to Horton which discloses a collapsible golf club stand having a pair of legs attached to a golf club shaft engaging member. To engage or disengage the golf club from the golf stand, the user must hold the stand in one hand in its closed position, gripping the upper portion of the legs and grip portion, and snap the lower end of the golf club shaft into or out of a recessed area. U.S. Pat. No. 5,076,581 to Boberg discloses a one-piece apertured prop for spacing the handgrip of a golf club from the ground. Although each of the above-described devices may accomplish the intended objective of maintaining a golf club in a position such that the handle does not contact the ground, it appears that none of these support devices has found commercial success.

In addition, several devices have been developed to assist the golfer in selecting an appropriate alignment of the golf club (or putter) with the intended line of play. These devices provide both support and alignment of a golf club. For example, U.S. Pat. No. 5,482,247 to Smith provides a golf club stand device having a connector portion which holds a portion of a golf club shaft, particularly a putter, and a leg structure portion which can support the putter in an upright position on a putting green such that the golfer can align his putts. The leg structure includes means to release the support legs from the extended position to a retracted position such that the golfer can putt with the device still connected to the putter shaft. U.S. Pat. No. 5,413,329 to Hirsch describes a golf club alignment guide for support a golf club in the form of a triangular bracket having C-shaped spring clamp for holding the shaft of a putter.

Despite the developments of the prior art, there is still a need for a support and alignment implement capable of supporting a golf club, putter or any conventional type club having an elongated shaft. Such a device should be simple to use, enabling the user to very quickly but securely engage or disengage a portion of the elongated shaft and should be capable of immediate use, that is, should not require that the user must set-up the device prior to or during use. In addition, such a device should be relatively lightweight and compact such that it can be stored in the user's pocket or the pocket of a golf club bag, or be clipped to the golf bag itself. Finally, such a device should be of simple construction and inexpensive to manufacture.

SUMMARY OF THE INVENTION

Accordingly, it is an object of the present invention to provide a support implement for supporting and maintaining an article having an elongated shaft in a desired position.

It is another object of the present invention to provide a support and alignment implement for supporting and maintaining a golf club in an upright position.

It is an additional object of the present invention to provide a support and alignment implement which can quickly but securely engage or disengage a portion of the elongated shaft.

It is still another object of the present invention to provide a support and alignment implement which is capable of immediate use which does not require that the user set-up the device prior to or during use.

It is yet another object of the present invention to provide a support and alignment implement which is relatively lightweight and compact such that it can be stored in the user's pocket or the pocket of a golf club bag or tackle box.

It is a further object of the present invention to provide a support and alignment implement which is of simple construction and inexpensive to manufacture.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION

The present invention relates to an implement for supporting and aligning a golf club, putter or similar club having an elongated shaft in an upright position. More particularly, the present invention provides a golfing accessory for supporting a golf club in an upright position and for aligning the club relative to the intended line of play.

Figure 1:
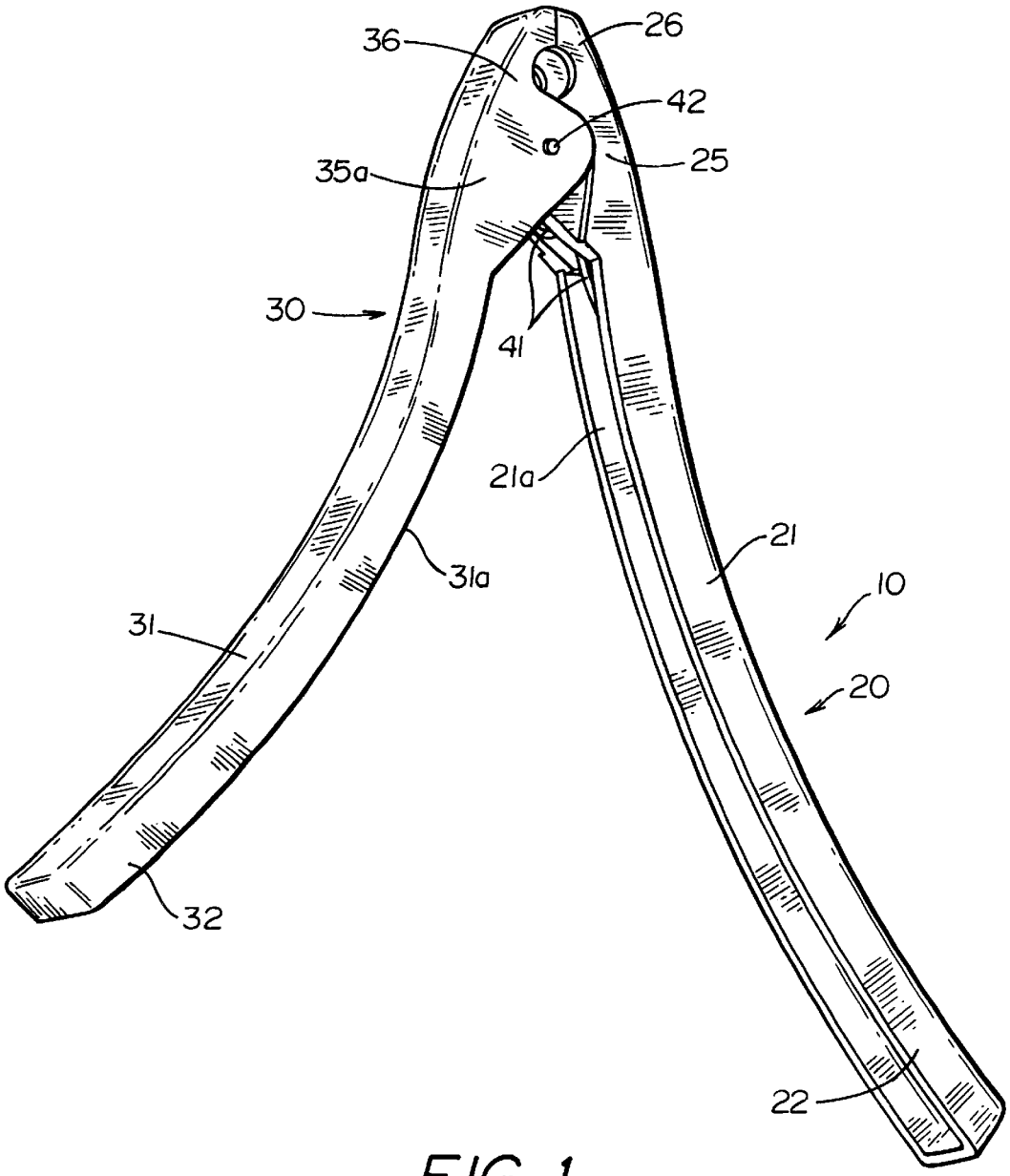
FIG. 1 illustrates a side perspective view of the golf support and alignment implement of the present invention.
Figure 2:
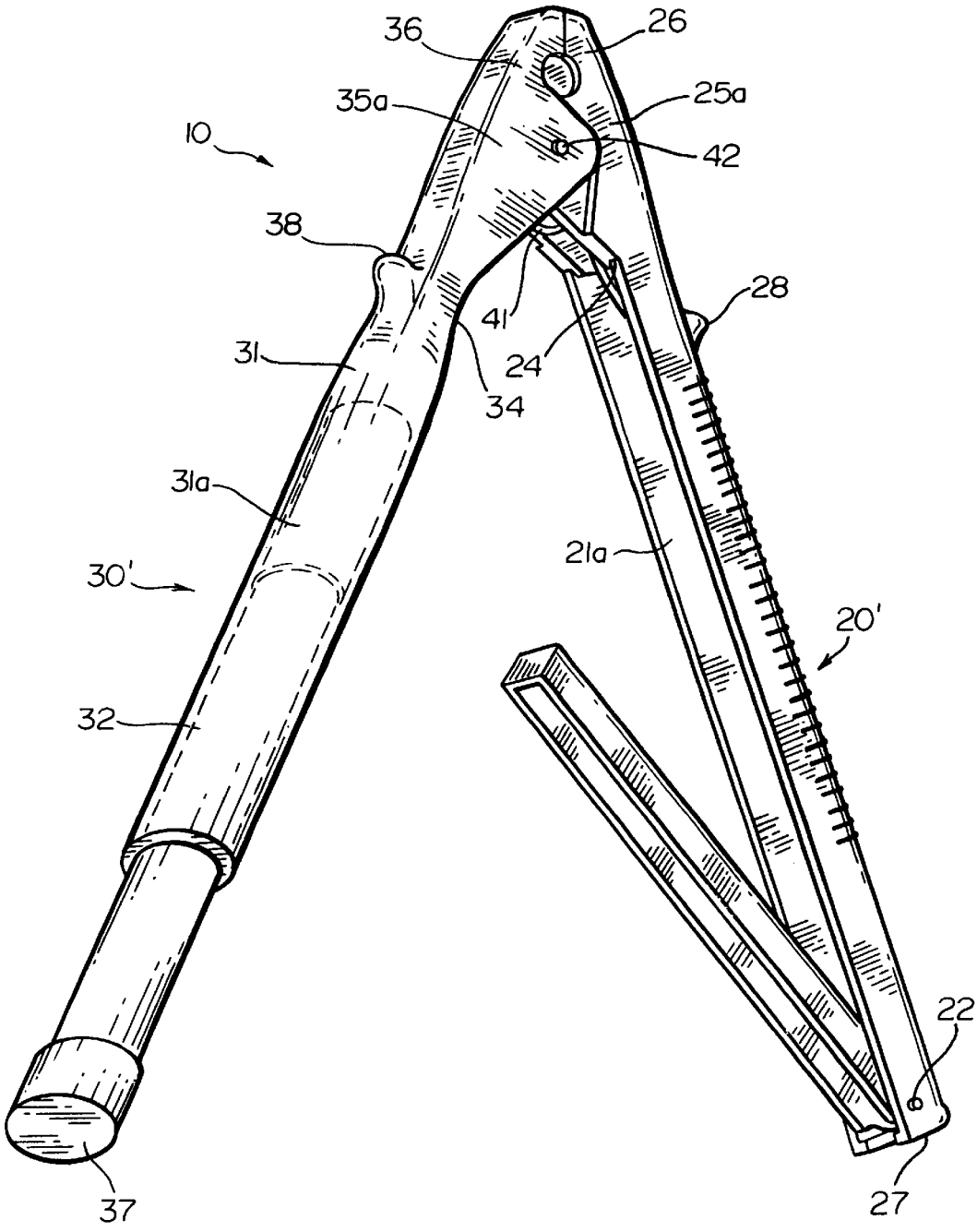
FIG. 2 illustrates a side/bottom perspective view of the support and alignment implement of the present invention.

Referring to FIGS. 1 and 2, the support and alignment implement 10 comprises a pair of leg members 20 and 30, a spring element 41 and a pivot pin 42. Leg member 20 comprises a main body 21 having a distal or ground engaging end 22, a C-shaped proximal or shaft gripping end 26 and a pair of flanges 25*a* and 25*b* projecting from the inner surface 21*a* and located near the proximal end. Similarly, leg member 30 comprises a main body 31 having a distal or ground engaging end 32, a C-shaped proximal or shaft gripping end 36 and a pair of flanges 35*a* and 35*b* projecting from the interior surface 31*a* and located near the proximal end. Each of the pair of flanges 25*a*/25*b* and 35*a*/35*b* is provided with a centrally disposed aperture.

Leg members 20 and 30 preferably are of a single-piece construction and may be manufactured from a solid material or a tubular material. Suitable materials for the leg members include, for example, wood, metal, fiberglass, plastic, graphite and rigid plastic materials, such as graphite. Preferably, each leg member is constructed from a plastic material, more preferably a rigid plastic material, such as ABS plastic or PVC plastic.

As shown in FIG. 1, the main body of each leg member 20 and 30 is provided with a longitudinal depression or cavity 24 and 34 respectively extending along the inner surface thereof. However, it is to be understood that the configuration of the leg members shown in FIG. 1 is simply one of many leg designs which may be utilized without departing from the spirit of the present invention. In an alternate embodiment as shown in FIG. 2, the support and alignment implement of the present invention may comprise extendable leg members. Suitable means for providing extendable leg members are well known in the art and may include, for example, a foldable/collapsible leg member, a leg member having a hinged extension, or a secondary leg member telescopically extendable from the main leg member as illustrated in FIG. 2.

Referring again to FIGS. 1 and 2, the pair of flanges 25*a* and 25*b* of leg member 20 are configured to cooperatively engage the pair of flange members 35*a* and 35*b* of leg member 30 such that a pivot pin 42 can be introduced through each of the centrally disposed apertures in each of the flanges, thereby joining the proximal ends of leg members 20 and 30 near the proximal end. In one embodiment, one pair of flanges can be inserted within the second pair of flanges. In an alternate embodiment, the two pairs of flanges can be overlapped. A spring element 41, such as a coil spring, is inserted between the two innermost flanges such that when the pivot pin 42 is introduced through each flange aperture, the spring element is retained within the innermost flanges by the pivot pin. The tension of the spring element forces the proximal ends of the leg members together in a closed position in such a manner that the two C-shaped gripping ends are brought together to define an "O" shape having a diameter slightly greater than that of the elongated shaft. The spring tension also forces the distal ends of the leg members away from each other, thereby creating a clamp-like implement. The diameter of the resulting "O" is, of course, determined by diameter of each of the C-shaped gripping ends. Larger diameter C-shaped gripping ends will result in a larger "O" shape to accommodate larger diameter elongated shafts.

Figure 4:
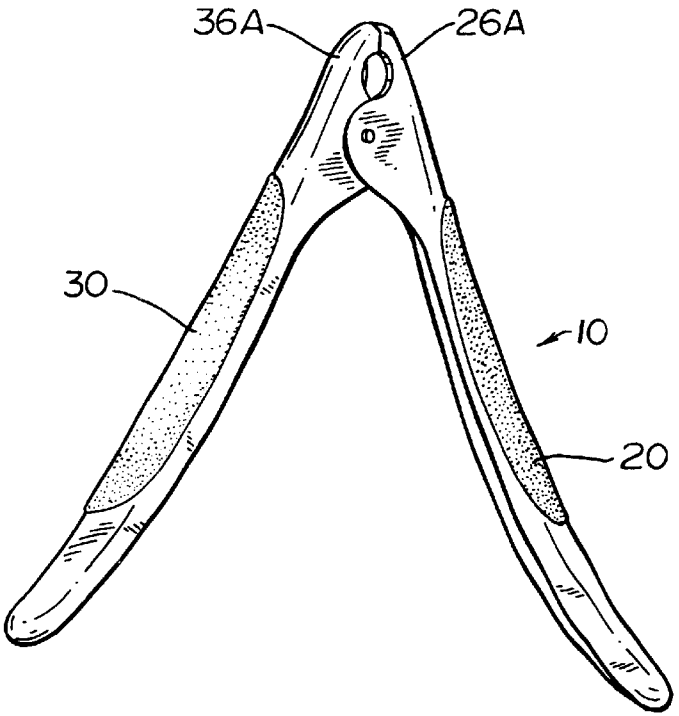
FIG. 4 illustrates a side perspective view of a preferred embodiment of the stretched "C" shaped gripping ends of the support and alignment implement of the present invention.

In a preferred embodiment, shown in FIG. 4, the C-shaped gripped ends 26A and 36A are configured as stretched "C" ends, thereby forming a teardrop configuration when the ends are brought together in the closed position, rather than the "O" configuration defined above. The use of the regular "C" shaped ends forming the "O" configuration about the shaft of the golf club results in only the top and bottom of the "O" contacting the shaft, thereby placing undue stress on the head of the device. By configuring the gripped ends 26A and 36A with stretched "C" ends, the resulting teardrop configuration formed in the closed position enables greater surface contact with the shaft of the golf club with thereby allows greater gripping effect and less stress on the head of the device.

The ground engaging ends 22 and 32 may be provided with end caps 27 and 37 respectively. Preferably, the end caps are composed of a rubber material, although any suitable material may be used for the end caps. The surface of each end cap may be configured with ridges, grooves or projections to enhance greater contact with the ground.

The outer surface of each leg member may be smooth as shown in FIG. 1, or may be modified to provide the user with a better grip. For example, as shown in FIG. 2, the outer surface of each leg member may textured. Examples of other modifications of the outer surface of each leg member include dimpling, cross-hatching or adhering of a textured or dimpled material as an overlay to the outer surface of each leg member. The outer surface of each leg member 20 and 30 also may be provided with a fingers support, 28 and 38 respectively, as shown in FIG. 2.

The inner surface of each C-shaped gripping end also may be modified to prevent damage to the elongated shaft and to enhance the gripping capability of the gripping ends. For example, the inner surface of each C-shaped gripping end may be provide with a rubber material. Moreover, the rubber material may be configured with grooves or teeth to enhance gripping contact with the elongated shaft In addition to rubber, suitable materials for modifying the inner surface of the gripping end include, for example, felts and synthetic resms.

Figure 3:
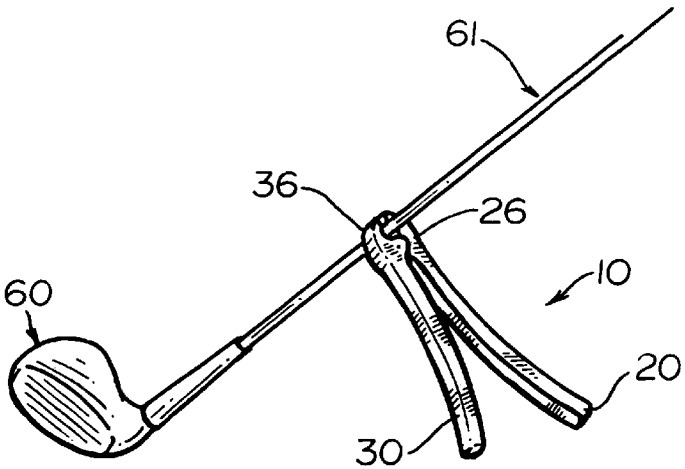
FIG. 3 illustrates a side perspective view of the support and alignment implement of the present invention attached to a golf club shaft.

FIG. 3 shows the support and alignment implement 10 of the present invention gripping the shaft of a golf club 60 such that the golf club can be maintained in an upright stance. In operation, to attach the golf club shaft 61 to the support and alignment implement 10, the distal ends 22 and 32 of the leg members 20 and 30 are brought together, such as by squeezing the leg members together in one hand, thereby forcing the proximal ends 26 and 36 away from one another and opening the C-shaped gripping ends. The golf club shaft 61 is inserted into the opening formed by the complementary C-shaped gripping ends such that the shaft is securely retained within the opening when the pressure on the distal ends is released. In this manner, the ground engaging ends of the leg members and the golf club head form a tripod type base as shown in FIGS. 3 and 6 which allows the golf club to be maintained in an upright position in the same manner as if the golfer or user was holding the club.

Figure 6:
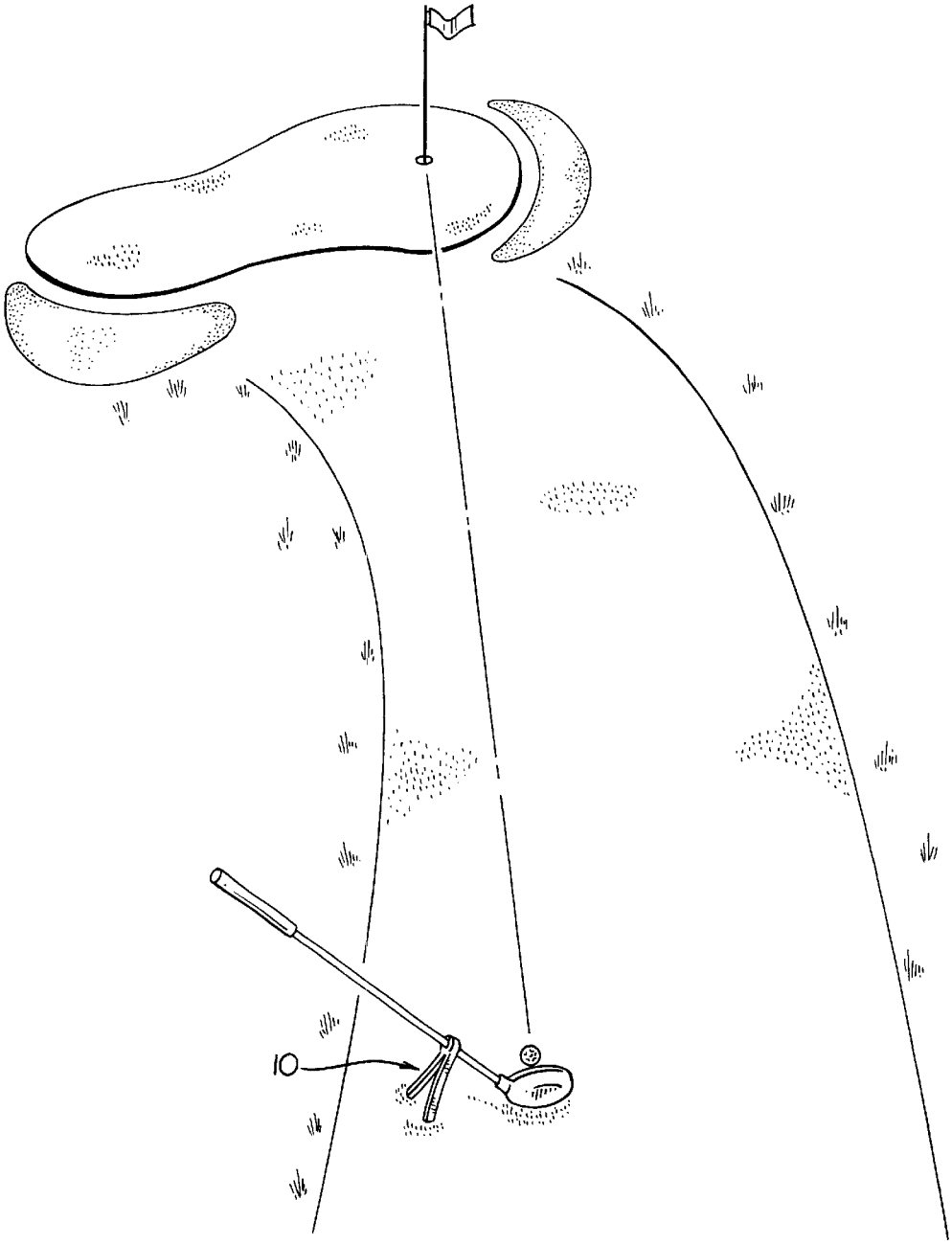
FIG. 6 is a perspective view of the support and alignment implement of the present invention supporting a golf club in an upright position on a fairway with alignment to the green.

Once the golf club is supported in an upright position corresponding to golfer's stance by the support and alignment implement 10 as shown in FIG. 6, the golfer can release his/her grip on the club and step away from the club in order to observe the selected alignment and angle of the club relative to the intended line of play. In this manner, the support and alignment implement of the present invention teaches the golfer how to visually align the club face square to the intended line of play and target.

Figure 5B:
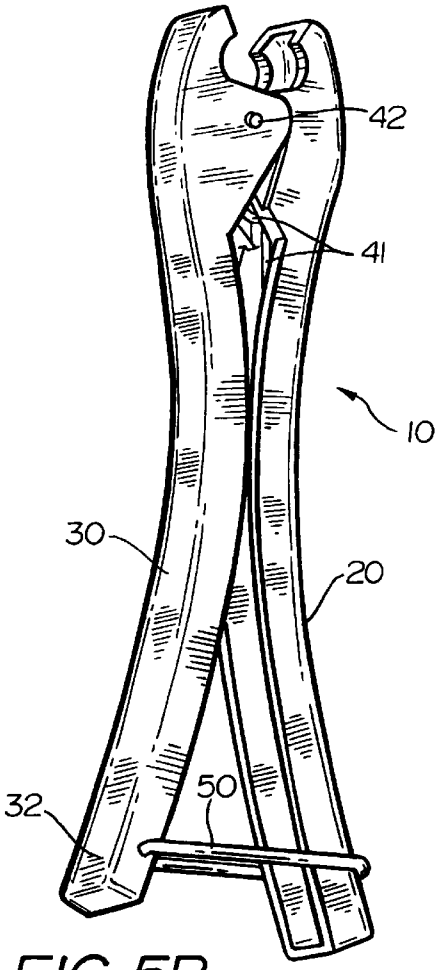
FIG. 5B illustrates a side perspective view of an alternative embodiment of the support implement with locking means in a closed configuration.
Figure 5A:
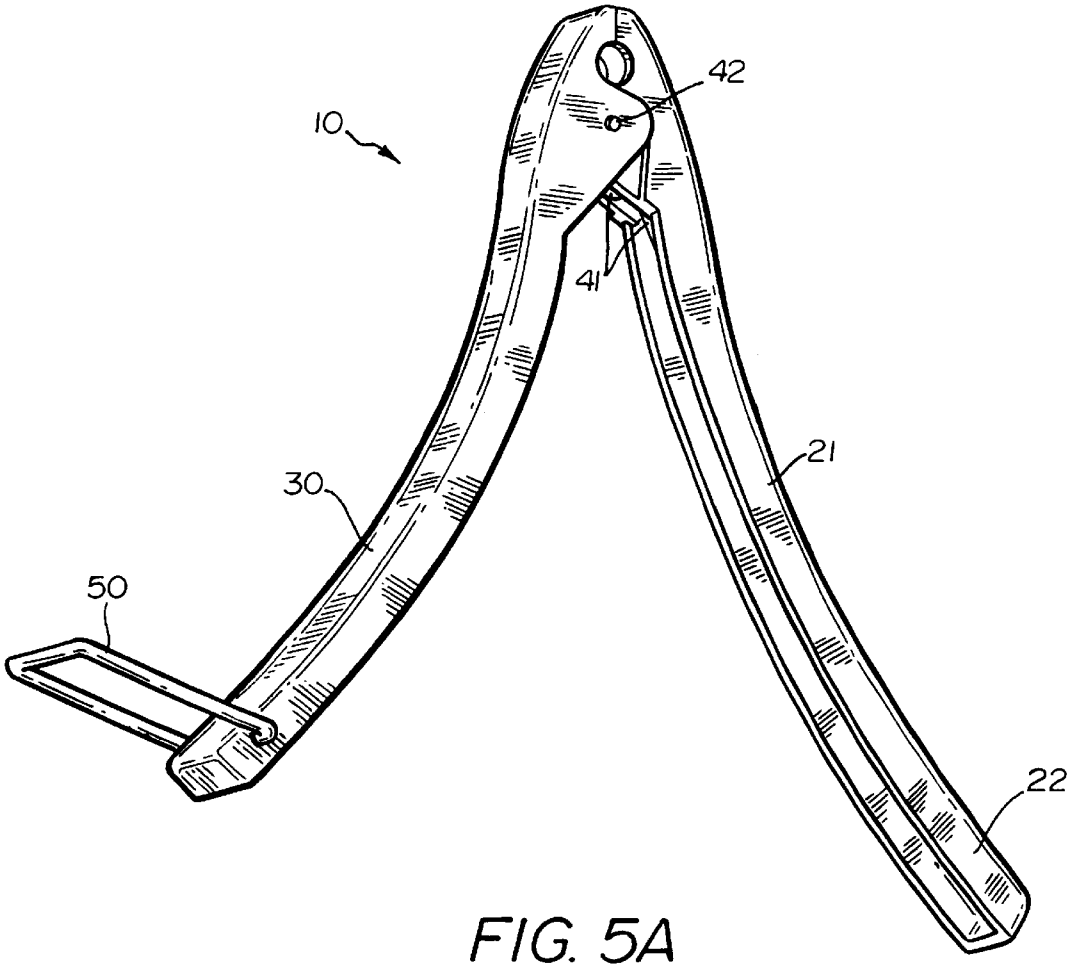
FIG. 5A illustrates a side perspective view of an alternative embodiment of the support implement having locking means in an open configuration.

FIGS. 5A and 5B show an alternative embodiment of the present invention wherein the support and alignment implement is provided with locking means, 50 to close the two ground engaging members. As shown in the drawings, the locking means can be in the form of a simple ring, connected to one of said leg members, such as leg member 30. However, as will be obvious to those skilled in the art, any equivalent locking means may be employed without deviating from the spirit of the invention.

Although the golf club support and alignment implement of the present invention can be used to support a single golf club as described above and shown in the drawings, it is to be understood that the device also can be used to support several clubs at the same time. For example, a golfer can use the device of the present invention to support both a pitching iron and putter on the rough surrounding the green.

While particular embodiments of the invention have been described, it will be understood, of course, that the invention is not limited thereto, and that many obvious modifications and variations can be made, and that such modifications and variations are intended to fall within the scope of this disclosure and the appended claims.

What is claimed is:

1. A method which provides a golf player with both a means to support a golf club and simultaneously with means to determine actual direct alignment of the face of the golf club with the intended line of play, the golf club having an elongated shaft, a gripping end and a club head end, said method comprising:

(1) installing a golf club support device onto the shaft of a golf club near the club head end, the golf club support device comprising:

(a) a pair of leg members, each of said leg members comprising:

(i) a distal ground engaging end and a stretched "C" shaped proximal end, an inner surface and an outer surface; and (ii) a pair of complementary flanges projecting from said inner surface near said proximal end, each of said pair of flanges having an aperture disposed therethrough and being configured to cooperatively engage the complementary pair of flanges projecting from the inner surface of the other of said pair of leg members in such a manner that a pivot pin can be introduced through each of said apertures disposed in each of said pair of flanges, thereby joining said stretched "C" shaped proximal ends of said pair of leg members; and (b) a spring element disposed between one of said pair of complementary flanges and retained within said pair of flanges by said pivot pin in such a manner that said stretched "C" shaped proximal ends of said pair of leg members are maintained in contact with one another in a closed position and extend away from one another to an open position when the distal ends of each leg member are brought together, wherein installation of the golf club support device onto the golf club shaft near the golf club head is accomplished by extending said stretched "C" shaped proximal ends of said pair of leg members to said open position, introducing the shaft of the golf club near the club head end between said stretched "C" shaped proximal ends and returning said proximal ends to said closed position such that the shaft of the golf club is retained securely between said proximal ends;

(2) holding the gripping end of the golf club and selecting an intended target and an intended line of play;

(3) positioning the golf club in such a manner that the face of the golf club head is perceived to be in direct alignment with both the intended line of play and the intended target area, and the golf club support device is disposed between the golf club head and the position of a golf player's stance;

(4) releasing the gripping end of the golf club shaft such that said distal ends of said pair of leg members and the club head of the golf club contact the ground to form a tripod-like configuration, the gripping end of the golf club extending upwardly, thereby placing the golf club in a perceived direct alignment with the intended line of play and the intended target; and (5) stepping away from the thus supported golf club and observing the selected visual alignment in order to determine whether the perceived direct alignment is actual direct alignment of the intended line of play and the intended target.

2. The method in accordance with claim 1, wherein in installing step each of said pair of leg members is extendable.

3. The method in accordance with claim 1, wherein in installing step the distal end of each of said leg members is provided with an end-cap.

4. The method in accordance with claim 3, wherein in installing step said end cap is configured with ridges, grooves or projections to enhance contact with a surface.

5. The method in accordance with claim 1, wherein in installing step the inner surface of each of said leg members is provided with a longitudinal depression.

6. The method in accordance with claim 1, wherein in installing step the outer surface of each of said leg members is textured or dimpled.

7. The method in accordance with claim 1, wherein in installing step inner surface at the stretched "C" shaped proximal end of each of said leg members is provided with a material to prevent damage to said elongated shaft when contacted therewith.

8. The method in accordance with claim 7, wherein in installing step said material to prevent damage to said elongated shaft when contacted therewith is rubber or synthetic resin.

9. The method in accordance with claim 8, wherein in installing step said rubber or synthetic material is configured with teeth or grooves to enhance gripping contact with said elongated shaft.

10. The method in accordance with claim 1, further comprising locking means to maintain said device for supporting and aligning a golf club in said open position.

11. The method in accordance with claim 1, wherein in installing step each of said pair of leg members is provided with a light weight material.

12. The method in accordance with claim 1, wherein in installing step said light weight material is selected from the group consisting of fiberglass, graphite and rigid plastic materials.

* * * * *